United States Patent [19]

Westergren

[11] Patent Number: 4,940,415

[45] Date of Patent: Jul. 10, 1990

[54] KEY SYSTEM FOR VACUUM CLEANER HOSE CONNECTION

[75] Inventor: George A. Westergren, Linwood Township, Anaka County, Minn.

[73] Assignee: Whirlpool Corporation, Benton Harbor, Mich.

[21] Appl. No.: 248,256

[22] Filed: Sep. 20, 1988

Related U.S. Application Data

[63] Continuation of Ser. No. 55,371, May 29, 1987, abandoned.

[51] Int. Cl.[5] ..... H01R 4/60

[52] U.S. Cl. ..... 439/192; 439/680

[58] Field of Search ..... 439/191, 192, 194, 203, 439/204, 680, 681, 677; 285/7

[56] References Cited

U.S. PATENT DOCUMENTS

| | | | |
|---|---|---|---|
| 2,774,949 | 12/1956 | Cardani et al. | 339/128 |
| 3,077,571 | 2/1963 | Curtis et al. | 439/680 |
| 3,146,054 | 8/1964 | Shearer et al. | 439/681 |
| 3,177,462 | 4/1965 | Sarnmark | 439/681 |
| 3,500,056 | 3/1970 | Riley | 307/13 |
| 3,534,317 | 10/1970 | Descarries et al. | 339/7 |
| 3,675,399 | 7/1972 | Westergren | 55/357 |
| 4,012,091 | 3/1977 | Westergren | 339/15 |
| 4,018,493 | 4/1977 | Lyman et al. | 339/15 |
| 4,094,535 | 6/1978 | Minton | 285/7 |
| 4,245,875 | 1/1981 | Shaffer et al. | 339/32 R |
| 4,423,919 | 1/1984 | Hillis | 439/680 |
| 4,449,737 | 5/1984 | Specht | 285/7 |
| 4,557,535 | 12/1985 | Keane | 439/192 |
| 4,618,195 | 10/1986 | Keane | 439/191 |
| 4,700,429 | 10/1987 | Martin et al. | 439/192 |

FOREIGN PATENT DOCUMENTS

| | | | |
|---|---|---|---|
| 832658 | 4/1960 | United Kingdom | 439/677 |

*Primary Examiner*—David Pirlot

*Attorney, Agent, or Firm*—Wood, Phillips, Mason, Recktenwald & VanSanten

[57] ABSTRACT

A vacuum cleaner structure having a canister provided with a suction inlet and a flexible hose having an end provided with a hose connector adapted to be received in the suction inlet. Male and female electrical connectors are associated with the suction inlet and hose end, and lock and key elements are provided in association with the suction inlet and hose end for permitting connection of the hose end to the suction inlet only in the event that the electrical terminal portion provided on the suction hose end is complementary to the electrical connector provided on the canister. The lock and key elements may be integrally formed with the canister and hose structures, or may be selectively fixedly secured thereto as desired.

13 Claims, 1 Drawing Sheet

FIG. 1
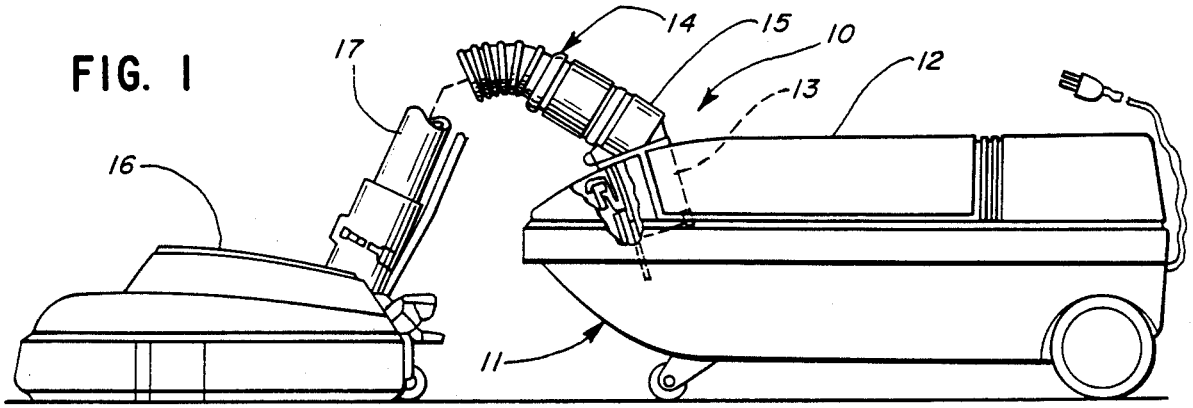
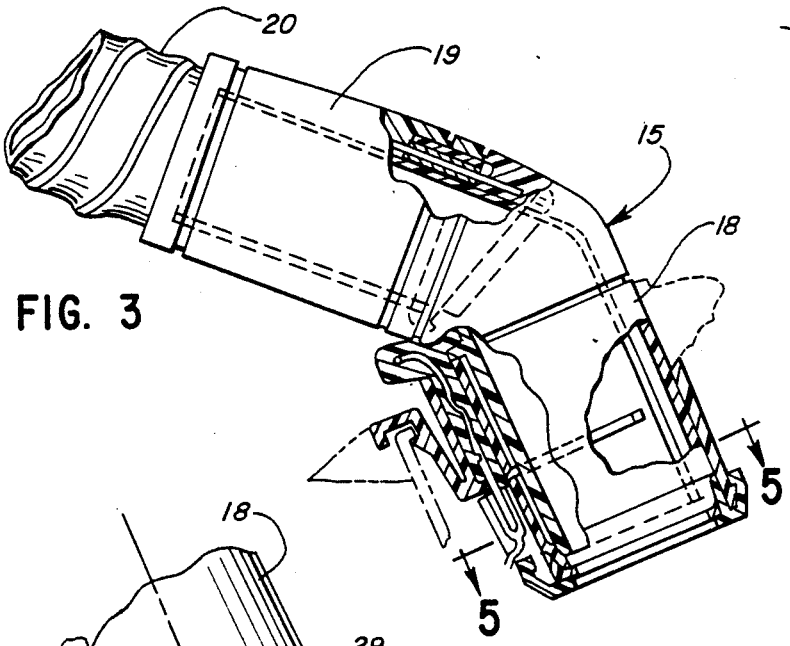
FIG. 3
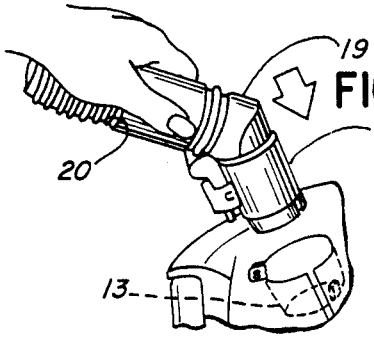
FIG. 2
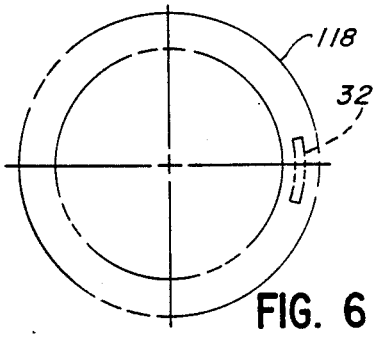
FIG. 6
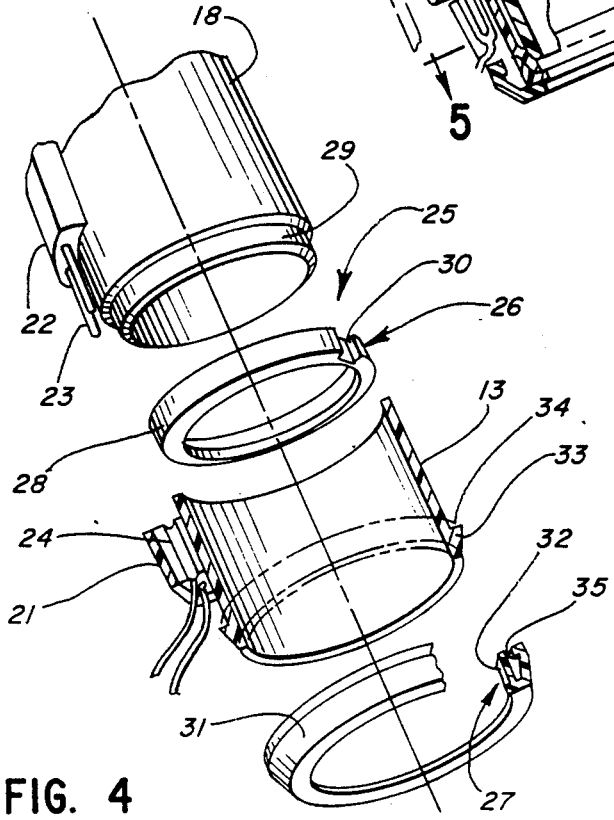
FIG. 4
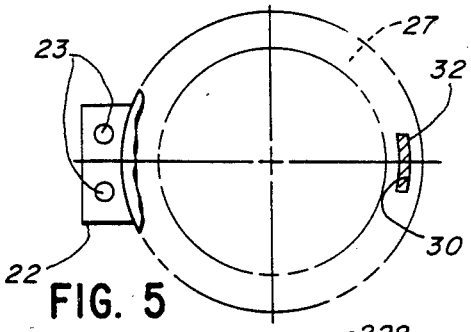
FIG. 5
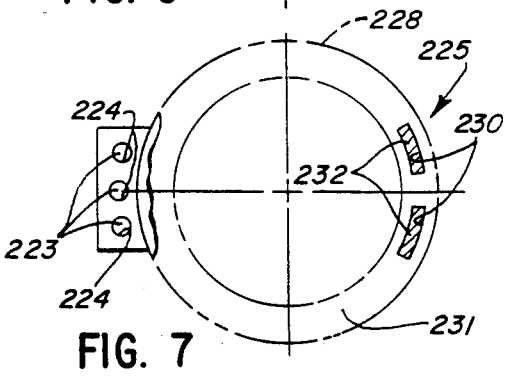
FIG. 7

KEY SYSTEM FOR VACUUM CLEANER HOSE CONNECTION

This application is a continuation, of application Ser. No. 055,371, filed May 29, 1987 now abandoned.

TECHNICAL FIELD

This invention relates to vacuum cleaner structures and in particular to structure for permitting connection of only properly complementary hose structure to the suction inlet of a vacuum cleaner canister.

BACKGROUND ART

In one form of vacuum cleaner, a canister is provided having a motor-driven suction fan and dust-collecting filter bag assembly. A suction nozzle is connected to the canister by a suction hose having an end removably connected to the suction inlet of the canister.

The opposite end of the hose is connected through a wand to the nozzle. The upper end of the wand defines a handle adapted to be engaged by the user in moving the nozzle over the floor surface. It is conventional to provide, in the wand at the handle portion, manually operable controls for controlling operation of the vacuum cleaner.

In certain of such nozzles, electrical apparatus is provided in the nozzle, one example thereof being the drive motor for rotatably driving the brush of the nozzle.

A number of different conductor arrangements are utilized in connection with such electrical controls and apparatus. Conventionally, electrical connection to the controls and nozzle-carried apparatus is effected by electrical conductors carried by the hose. The conductors are provided at the opposite ends of the hose with electrical terminal connectors. The wand includes an electrical terminal connector complementary to the terminal connector on the end of the hose connected thereto, and the canister is provided with an electrical connector complementary to the electrical connector on the end of the hose connected thereto. Depending on the required electrical connections, different types of electrical connectors are required.

It is further conventional to provide the electrical connectors on the hose in such an arrangement as to permit automatic interconnection thereof to the associated terminal connectors of the canister and wand, as a result of the connection of the hose ends mechanically thereto. One example of such structure is illustrated in U.S. Pat. No. 4,018,493 of John Lyman et al., which patent is owned by the assignee hereof.

DISCLOSURE OF INVENTION

The present invention comprehends an improved vacuum cleaner structure having means for permitting connection of a hose end to the canister only if the proper electrical connector is associated therewith. Thus, the invention comprehends the provision of means for preventing mechanical connection of a hose end to the suction inlet of a canister unless the proper electrical connector is associated therewith.

More specifically, the invention comprehends the provision in a vacuum cleaner structure having a canister provided with a first hose connector defining a suction inlet and a first electrical connector associated with the suction inlet, and a suction hose provided with an end portion defining a second hose connector adapted to be removably connected to the first hose connector, the hose connectors comprising complementary male and female connectors, and a second electrical connector associated with the second hose connector adapted to be electrically connected to the first electrical connector as an incident of the second hose connector being connected to the first hose connector, and cooperating lock and key means associated with the hose connectors for permitting introduction of the male connector into the female connector only in the event the key is complementary to the lock.

In the illustrated embodiment, the lock and key means comprises any one of a plurality of different complementary lock and key combinations.

The lock and key means, in the illustrated embodiment, comprises elements fixedly secured to the canister and suction hose.

The lock and key means comprise annular elements having complementary projection and recess portions.

The vacuum cleaners structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary side elevation of a vacuum cleaner structure having suction hose connection means embodying the invention;

FIG. 2 is a fragmentary perspective view illustrating the connection of the hose end to the canister suction nozzle;

FIG. 3 is a fragmentary side elevation partially in diametric section illustrating the connection of the hose end to the suction nozzle;

FIG. 4 is a fragmentary exploded perspective view illustrating the mounting of the lock and key means to the hose end and suction nozzle;

FIG. 5 is a schematic representation taken substantially along the line 5—5 of FIG. 3 of a vacuum cleaner structure having a suitable lock and key means for use with a two-wire electrical connector;

FIG. 6 is a schematic representation similar to that of FIG. 5 but illustrating the arrangement where no electrical connector is utilized; and FIG. 7 is a schematic representation similar to that of FIG. 5, but illustrating the arrangement of the lock and key means where a three-wire electrical connector is utilized.

BEST MODE FOR CARRYING OUT THE INVENTION

In the illustrative embodiment of the invention as disclosed in the drawing, a vacuum cleaner structure generally designated 10 is shown to comprise a canister 11 having a hood 12 provided with a suction inlet 13.

A hose 14 is provided at one end, with a hose connector 15 adapted to be removably connected to the suction inlet 13 for conducting dirt-laden air from a suction nozzle 16 to the canister. Hose 14 is connected to the nozzle through a wand 17.

In the illustrated embodiment, suction inlet 13 comprises a female connector mounted to the canister hood 12. Hose connector 15 comprises a swivel hose connector including a tubular end portion 18 and a swivel portion 19 connected to the flexible hose portion 20.

As shown in FIG. 4, suction inlet 13 has associated therewith a first electrical connector 21 which, in the illustrated embodiment, comprises a female electrical terminal connector. Hose end 18 has associated therewith a second electrical connection 22 which, in the illustrated embodiment, comprises a male terminal connector complementary to female connector 21. Connector 22 is mounted to hose end portion 18 in such a manner as to be automatically electrically connected to connector 21 when the hose end portion 18 is received fully within the suction inlet 13, as shown in FIG. 3.

Electrical connectors 21 and 22 illustratively comprise two-wire connectors having a pair of male terminals 23 and a pair of female terminals 24 respectively. Means are provided to assure that a hose end having the two-terminal male connector 22 is the only hose end which will be accepted by the suction inlet 13 having the two-wire terminal connector 21.

More specifically, as shown in FIG. 4, the invention comprehends the provision of a lock and key means generally designated 25 associated respectively with the suction inlet and hose end preventing introduction of the hose end portion 18 into the suction inlet whenever the lock means generally designated 26 is not complementary to the key means 27 associated with the suction nozzle.

In the illustrated embodiment, lock means 26 comprises a ring 28 adapted to be secured to an end portion 29 of the hose end 18 and which is provided with a radially outwardly opening recess 30. In the illustrated embodiment, ring 28 is secured to hose end portion 29 as by sonic welding thereof to the hose end portion.

Key means 27 comprises a ring 31 having a radially inwardly projecting lug 32 complementary to recess 30. Ring 31 is fixedly secured to the distal end 33 of suction inlet 13 which, in the illustrated embodiment, is radially outwardly enlarged to define an annular shoulder 34 cooperating with a complementary annular shoulder 35 on the ring 31 for securing the ring to the suction inlet end portion 33.

As shown, the ring 28 is secured to the hose end portion 29 in a preselected relationship to the location of electrical connector 22 on hose end portion 18 so that the terminals 23 are automatically aligned with the female terminals 24 of electrical connector 21 on suction inlet 13 when the recess 30 is aligned with lug 32. Thus, the electrical connection is automatically made upon full insertion of the male hose end 18 into the female suction inlet 13 permitted by the aligned relationship of the recess 30 and lug 32, as shown in FIG. 3. This relationship is further shown in FIG. 5.

As indicated briefly above, the invention comprehends the prevention of the connection of an incorrect hose end to the suction inlet. Thus, as illustrated in FIG. 6, a suction hose having an end 118 having no reduced end portion 29 will be prevented from entering fully into the suction inlet by the lug 32 abutting the distal end surface of hose end 118.

Similarly, as illustrated in FIG. 7, where the electrical system uses a three-wire system utilizing three terminals, including male terminals 223 and female terminals 224, the lock and key means 225 may utilize a pair of lock recesses 230 and a corresponding complementary pair of key lugs 232. Thus, a hose end having a lock recess 30 will be prevented from being fully inserted into the suction inlet as the recess 30 does not align with the two lugs 232. Only a hose end having the appropriate lock ring 228 can be inserted fully into the suction inlet having a key ring 231 provided with the two lugs 232. Thus, only an appropriate hose end having a three-wire male terminal connector can be fully inserted into the suction inlet provided with the key ring 231.

Thus, the invention comprehends the use of lock and key means for assuring the provision of a proper electrical connector on the hose end before admitting the hose end into mechanical connection with the suction inlet of a vacuum cleaner canister. Further, as the lock and key means are accurately located relative to the location of the electrical connectors, automatic alignment of the electrical connectors is effected when the lock and key means are properly aligned. Reversely, when the electrical terminal connectors are properly aligned, the lock and key means are automatically properly aligned for reception of the hose end fully into the suction inlet.

Broadly, the invention comprehends the provision of lock and key means comprising any one of a plurality of different complementary lock and key combinations, and as will be obvious to those skilled in the art, the lock means may be provided on the suction inlet and the key means provided on the hose end, if desired.

The lock and key means, in the illustrated embodiment, comprise annular elements having complementary projection and recess portions. The invention comprehends that the lock and key means may be fixedly secured to the hose end and suction inlet whereby facilitated manufacture of vacuum cleaner structures having different lock and key means coordinated with different electrical terminal connectors may be effected.

In the illustrated embodiment, the lock and key rings are secured by sonic welding to the hose end and canister structures, respectively.

As further illustrated, one or more of the lock and key rings may be removably connected, such as by snap-fitting to the associated structure.

In the illustrated embodiment, different lock and key configurations are obtained by utilizing different numbers of the recesses and complementary lugs. Other complementary configurations may be utilized within the broad scope of the invention.

The invention further comprehends that either or both of the hose end and suction inlet have the lock and key means associated therewith integrally formed therein, such as by molding of the elements of synthetic resin.

The foregoing disclosure of specific embodiments is illustrative of the broad inventive concepts comprehended by the invention.

I claim:

1. In a vacuum cleaner structure having a canister provided with a first hose connector defining a cylindrical suction inlet and a suction hose provided with a tubular end portion defining a second hose connector, said first and second hose connectors configured to be assembled into coaxial operative relationship, one within the other, by effecting relative axial movement of said first and second hose connectors, the improvement comprising;

a fisrt male electrical connector;

a first male electrical connector complementary to said first male electrical connector;

means for attaching one of said first male and female electrical connectors to one of the first and second hose connectors and the other of the first male and female electrical connectors to the other of the first and second hose connectors so that the first male electrical connector is electrically connected to the first female electrical connector as an incident of the first and second hose connectors being moved axially relative to each other into their operative relationship;

a second male electrical connector;

a second female electrical connector complementary to said second male electrical connector;

means for attaching one of said second male and female electrical connectors to one of the first and second hose connectors and the other of the second male and female electrical connectors to the other of the first and second hose connectors so that the second male electrical connector is electrically connected to the second female electrical connector as an incident of the first and second hose connectors being moved axially relative to each other into their operative relationship;

complementary first annular lock and key elements indicative of said first male and female electrical connectors for mounting one each to said first and second hose connectors with the first male and female electrical connectors attached to said first and second hose connectors and for permitting movement of the first and second hose connectors into operative relationship and concurrently electrical connection of the first male and female electrical connectors; and complementary second annular lock and key elements, both being different than the corresponding first annular lock and key elements, indicative of said second male and female electrical connectors, for mounting one each to said first and second hose connectors with the second male and female electrical connectors attached to said first and second hose connectors and for permitting movement of the first and second hose connectors into operative relationship and concurrently electrical connection of the second male and female electrical connectors, said first and second complementary annular lock and key elements further including cooperating means for preventing movement of the first and second hose connectors into operative relationship with (1) the first male electrical connector on one of the first and second hose connectors and the second female electrical connector on the other of the first and second hose connectors and (2) the second male connector on one of the first and second hose connectors and the first female electrical connector on the other of the first and second hose connectors and thereby inadvertent electrical connection of the first male connector to the second female connector and the second male connector to the first female connector.

2. The vacuum cleaner structure of claim 1 wherein said complementary first and second annular lock and key elements define complementary projection and recess portions.

3. The vacuum cleaner structure of claim 1 wherein one of said annular first and second lock and key element is sonically welded to said canister.

4. The vacuum cleaner structure of claim 1 wherein one of said annular first and second lock and key elements is snap-fitted to said first hose connector.

5. The vacuum cleaner structure of claim 1 wherein said annular first and second lock and key elements comprise a first ring fixedly secured to said first hose connector and a second ring fixedly secured to said second hose connector to permit reception of said second hose connector fully in said first hose connector in only a single orientation of said rings about the axes thereof.

6. The vacuum cleaner structure of claim 1 wherein said annular first and second lock and key elements comprise a first ring fixedly secured to said first hose connector and a second ring fixedly secured to said second hose connector, said key element comprising a radially projecting lug on one of said rings and said lock element comprising a complementary radially opening recess on the other of said rings arranged to permit reception of said second hose connector fully in said first hose connector in only a single orientation of said rings about the axes thereof.

7. The vacuum cleaner structure of claim 1 wherein said annular first and second lock and key elements comprise a first ring fixedly secured to said first hose connector and a second ring fixedly secured to said second hose connector, said key element comprising a plurality of radially projecting lugs on one of said rings and said lock element comprising a plurality of complementary radially opening recesses on the other of said rings arranged to permit reception of said second hose connector fully in said first hose connector in only a single orientation of said rings about the axes thereof.

8. The vacuum cleaner structure of claim 1 wherein said male and female electrical connectors define any one of a plurality of different complementary electrical terminal arrangements.

9. The vacuum cleaner structure of claim 1 wherein said canister is provided with a hood carrying said first hose connector and one of said first male and female electrical connectors, and said suction hose is provided with a swivelable end portion defining said second hose connector adapted to be removably connected to said first hose connector.

10. The vacuum cleaner structure of claim 1 wherein said first hose connector comprises a female hose connector and said second hose connector comprises a male hose connector.

11. The vacuum cleaner structure of claim 1 wherein said first and second annular lock and key elements include a lug extending radially inwardly from said first hose connector.

12. The vacuum cleaner structure of claim 1 wherein said first and second annular lock and key elements include a lug extending radially inwardly from said first hose connector and means defining a recess opening radially outwardly in said second hose connector.

13. The vacuum cleaner structure of claim 1 wherein said male and female electrical connectors comprise any one of a plurality of different electrical connectors having different numbers of electrical terminals.

* * * * *